United States Patent [19]

Cheng

[11] Patent Number: 4,764,128

[45] Date of Patent: Aug. 16, 1988

[54] DISTRIBUTION HANGER FOR DECORATIVE LIGHT STRING

[76] Inventor: Sam Cheng, No. 11, Lane 207, Hsimen Street, Hsin-Cho, Taiwan

[21] Appl. No.: 921,356

[22] Filed: Oct. 20, 1986

[51] Int. Cl.[4] ..... H01R 21/00

[52] U.S. Cl. ..... 439/652; 439/505; 439/655

[58] Field of Search ..... 339/119 C, 147 C, 154 R, 339/154 A, 156 R, 157 R, 157 C, 159 R, 159 C, 163, 166 R; 439/527, 652, 655, 502, 505

[56] References Cited

U.S. PATENT DOCUMENTS

| | | | |
|---|---|---|---|
| 1,843,389 | 2/1932 | Fischer | 339/157 C |
| 1,891,341 | 12/1932 | Barocas | 339/163 X |
| 2,039,916 | 5/1936 | McIntosh | 339/157 C X |
| 2,089,856 | 8/1937 | Reynolds | 339/156 R |
| 2,474,356 | 6/1949 | Harris | 339/157 C X |
| 2,509,809 | 5/1950 | Cook | 339/157 C |
| 2,576,165 | 11/1951 | Wood | 339/157 C |
| 3,214,579 | 10/1965 | Pacini | 339/157 C |
| 4,591,227 | 5/1986 | Colonna | 339/157 C |

*Primary Examiner*—Z. R. Bilinsky
*Attorney, Agent, or Firm*—McGlew and Tuttle

[57] ABSTRACT

Distribution hanger for decorative light strings comprises: a distribution box made of insulation material, a power inlet plug, conductor wires connected within the box to provide a plurality of outlet sockets and/or connectors for lamp seat, for distribution or cascading string sets thereof, and a hanging hook or ring made integrally with the box; advantageously, the lid of the box is also made integral. The hanger gives synergetic effects of interest and variation.

7 Claims, 7 Drawing Sheets

DISTRIBUTION HANGER FOR DECORATIVE LIGHT STRING

FIELD OF THE INVENTION

The present invention relates generally to an improvement of decorative light string sets and more particularly to a distribution hanger and box with a power inlet, conductor wiring within the box and a plurality of outlet sockets to facilitate the distributing or cascading of light strings with great convenience as well as providing synergetic effects of interests and providing variations. Hook or ring means for hanging as well as the lid of the box may be molded integrally with the body of the box with plastic insulation material.

BACKGROUND OF THE INVENTION

Decorative light strings have long been used for years to provide decorative effects, however, the assembling process is quite painstaking and time consuming and the decorative effect is minimal.

SUMMARY OF THE INVENTION

The present invention provides a distribution hanger in the form of a box with hanging means attached and having a power inlet, conductor wires within the box and a plurality of outlet of sockets and/or connectors for lamp seats. The box may be hung at an elevated position such as the top of a tree, a door frame, wall panel etc, for the distribution or cascading therefrom of multiple string sets. Since the unit power consumption of individual string is low, risk of overload can be avoided without question.

The box may be of any geometric possible shape such as round, square, rectangular etc wherever feasible. The hanging means may be in the form of a ring, a hook etc which can be integrally formed with the box through moulding of plastic material of insulative nature, or otherwise attached separately. The wiring of the conductor within the box may be in series, parallel and/or a combination thereof and the outlet may be connector of plain wire ends or provided with socket to facilitate the plug-in of the individual string, said socket may possess a flasher by itself, to take strings of normal lit type and/or flashing ones, in the latter cases, the resulted flashing effect can be synergetic.

Another object of the present invention is to provide a distribution hanger having the casing constituted of a box body with a lid, or a pair of adjacently jointed halves. In either case the parts may be formed integrally so that the manufacturing made easy and the cost is greatly reduced due to the saving of procedure and/or materials.

A further object of the present invention is to provide a distribution hanger of great versatility and great convenience, with an exceptional safety range, wherein a single unit would perform the job of a multiple sets of conventional sockets. The variation in service is almost unlimited with increased efficacy.

Further objects and features of the present invention will become apparent through the following detailed description in accompany with the annexed drawings.

BRIEF DESCRIPTION OF DRAWINGS

FIG. 5A, shows the interior wiring of the embodiment of FIG. 5A;

FIGS. 6A and 6B are wiring alternatives of the flasher means, while

DETAILED DESCRIPTION OF PREPERRED EMBODIMENTS

Figure 1A:
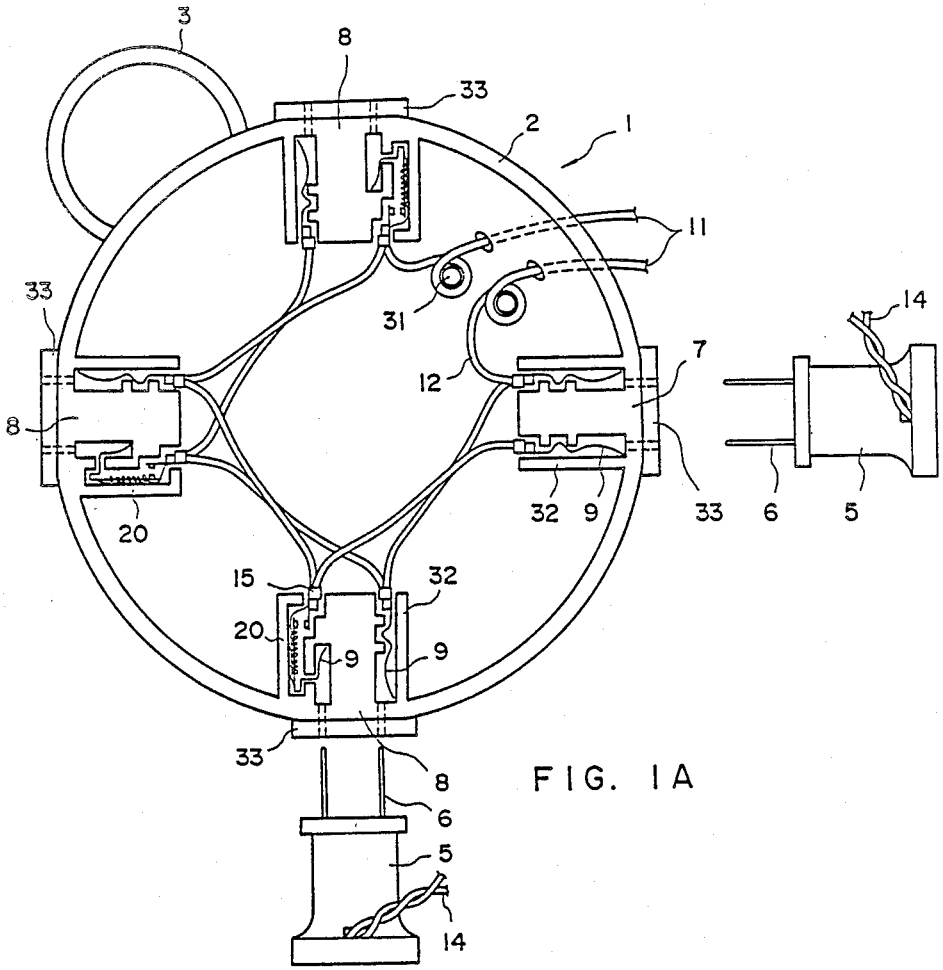
FIG. 1A is an embodiment of the distribution box of the present invention having a circular configuration with the lid taken-off to show the interior wire connections.
Figure 1C:
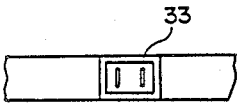
FIGS. 1B and 1C each show a protection wall of the outlet socket.
Figure 1B:
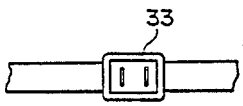

Now referring to FIG. 1, a preferred emvodiment of the present invention is shown, wherein the distribution box 1 is of circular configuration and constituted of a casing 2 of insulating material, a lid (now being taken off to facilitate the illustration of interior wiring) may be adhered or riveted on the casing 2 to where a hanging ring 3 is formed integrally therewith. Power inlet 11 is led into the box first wound on anchoring post 31, then connected in parallel to a plurality of outlet sockets, four being shown here with one plain socket 7 composed of a pair of plain electrode or blade 9 and three flasher sockets each composed of a plain electrode 9 and a flasher electrode formed by connecting in series at terminal 15, a flasher assembly 20 and a plain blade 9. The flasher assembly 20 shall be detailed later on through FIG. 6. Partitions 32 are provided to facilitate the fixation and isolation of electrode and parts etc. The four outlet sockets disposed surround the out periphery of the casing 2, and each provided with a raised protection wall 33 such as shown in FIGS. 1B and 1C. Dimension of said wall 33 may be decided as desired according to the plug to be taken. Plug 5 may lead to a normal lit string or flasher string. A flasher string plugged into a flasher socket 8 would result in a flash composite of flashing frequency having synergetic effect.

Figure 2B:
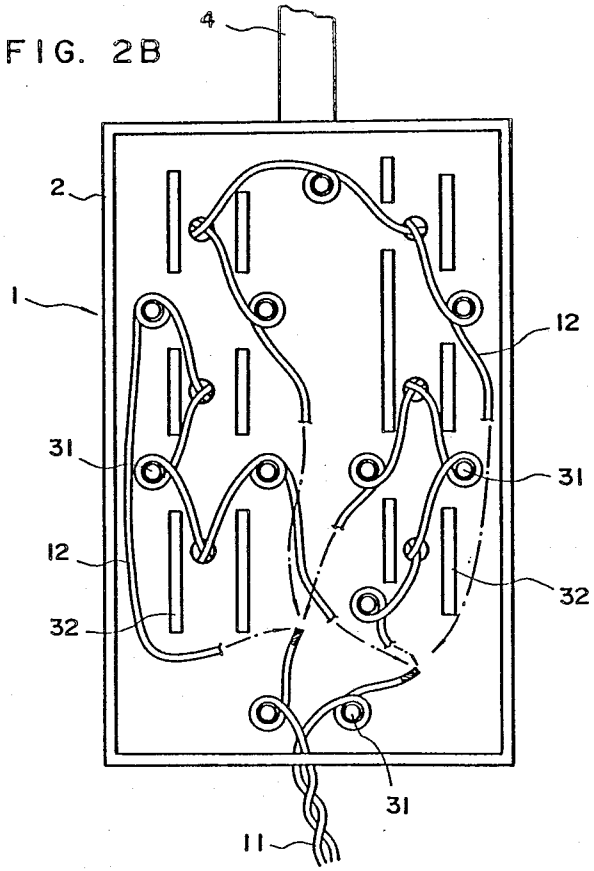
FIG. 2B depicts its interior wiring.
Figure 2A:
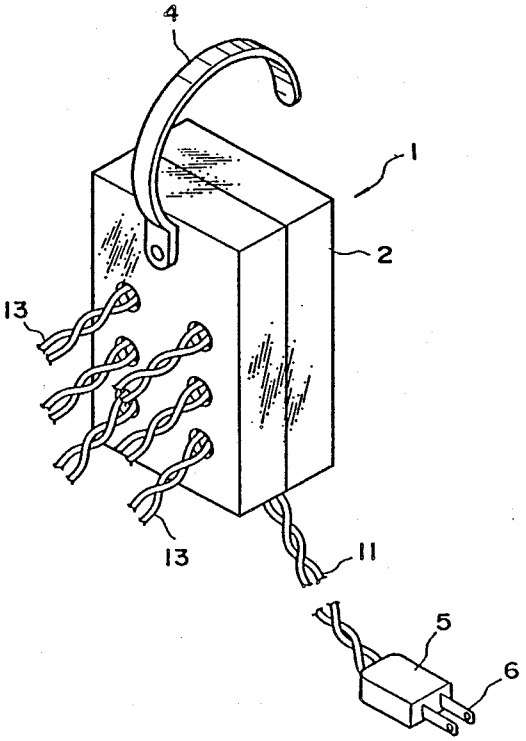
FIG. 2A shows another embodiment of the distribution box of the present invention having a square configuration.

In a square distribution box 1 such as shown in FIG. 2, the insulated casing 2 has a hanging hook 4 attached thereon, power is led into the box through inlet 11 via a power plug 5', within the box 1, anchoring posts 31 and partitions 32 are provided wherever called for. The wiring 12 in this embodiment is made series-parallel and led out through one side of the casing wall in extension pairs 13 for connecting to individual string which may include normal lit string or flasher ones.

Figure 3B:
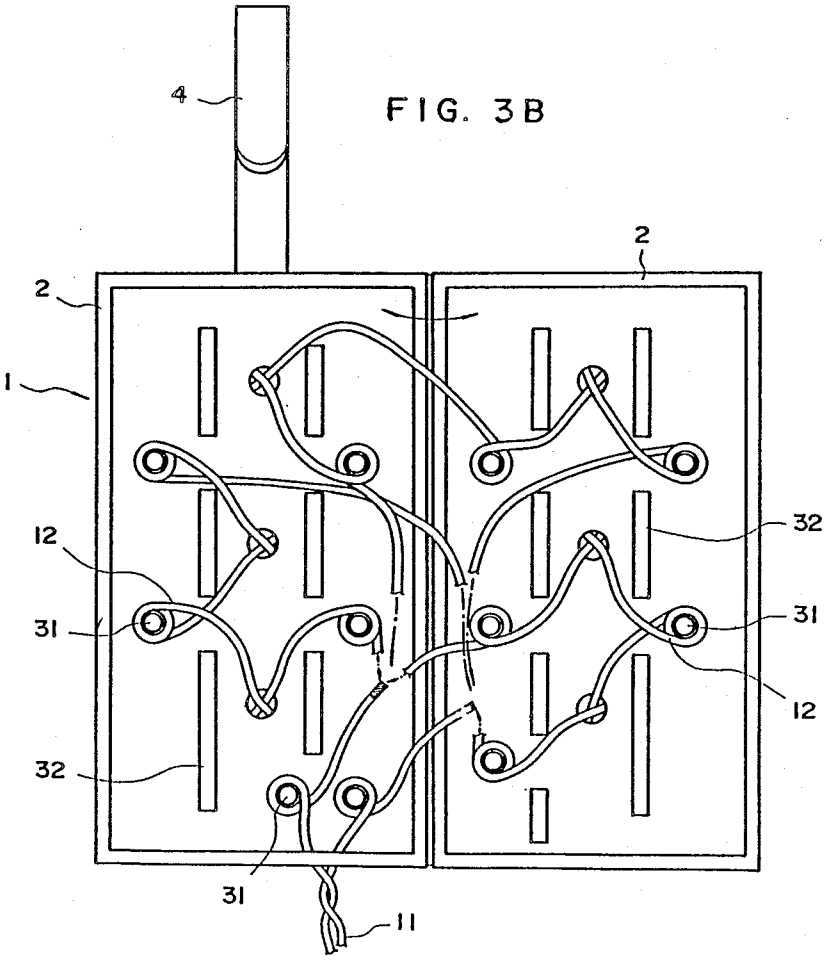
FIG. 3B depicts its interior wiring.
Figure 3A:
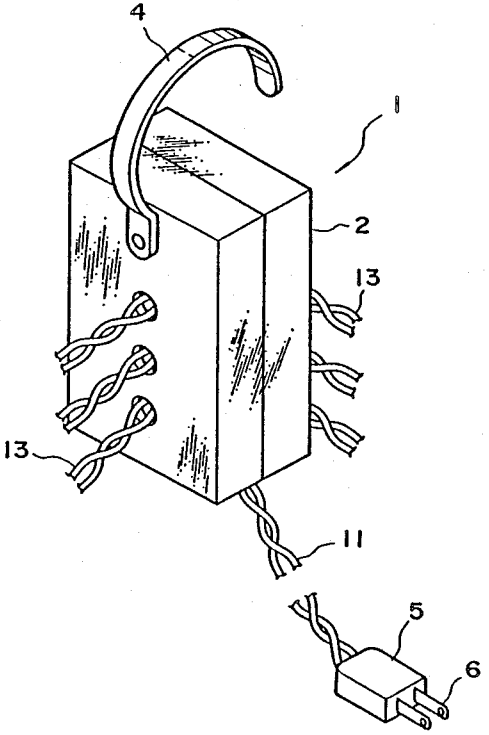
FIG. 3A shows still another embodiment in perspective, also having a square configuration.

FIG. 3 resembles the embodiment of FIG. 2, except that the outlet loads are evenly divided into the two halves of the side wall 2, the loads may be of flasher or non-flasher type.

Figure 4B:
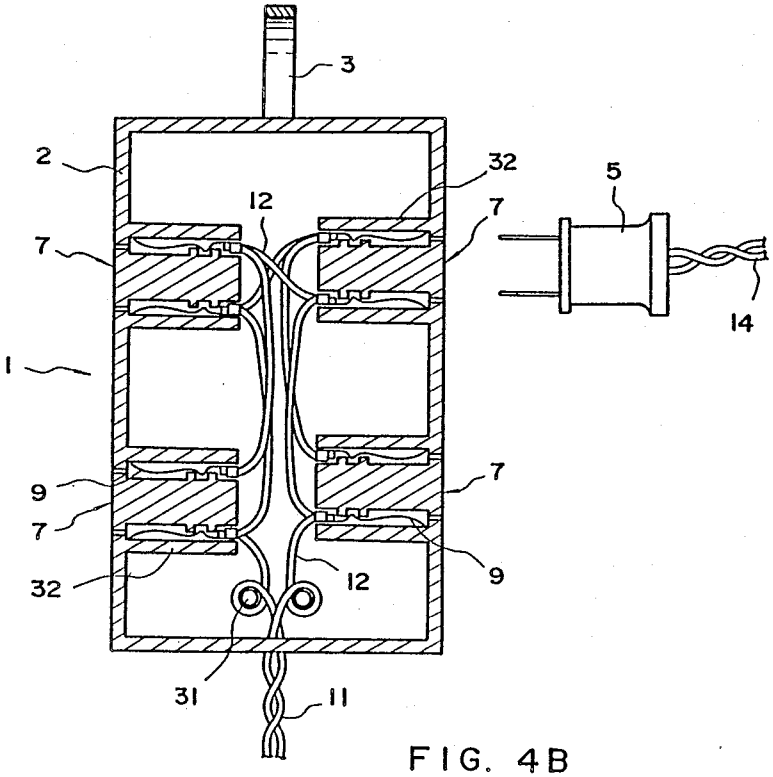
FIG. 4B, shows the interior wiring of the embodiment of FIG. 4A.
Figure 4A:
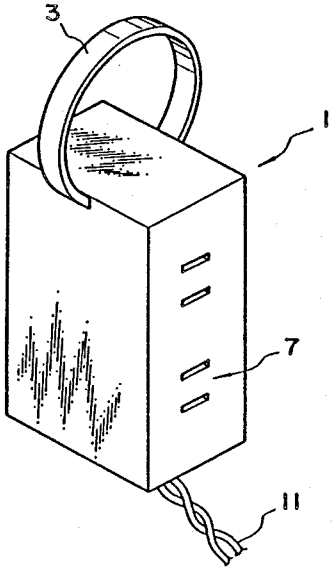
FIG. 4A shows a further embodiment in perspective, yet having a rectangular configuration.

The rectangular shaped distribution box shown in FIG. 4 is provided with a haging ring 3, conductor 11 after led into the box and anchored to post 31, the wire 12 is distributed parallelly among four plain socket 7. Electrodes are fixed and isolated by partition means 32 and the outlet is taken by lug 5 through wire 14 to loads of strings having flasher or non-flasher variations.

Figure 5B:
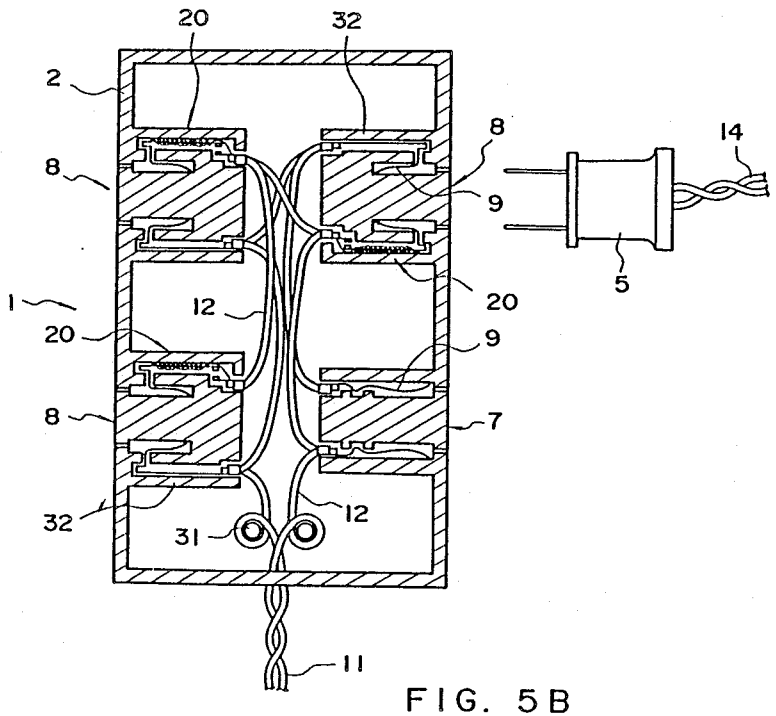
FIG. 5A shows a perspective view of a still further embodiment of a distribution box of rectangular configuration.
Figure 5A:
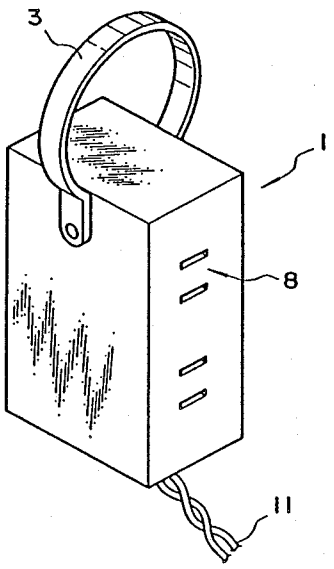

Embodiment in FIG. 5 resembles that shown in FIG. 4, except that three flasher outlets 8 and one plain outlet 7 are provided instead of four plain ones. The interior wiring is of parallel type. The detail of the flasher socket is now to be described in FIG. 6.

Figure 6B:
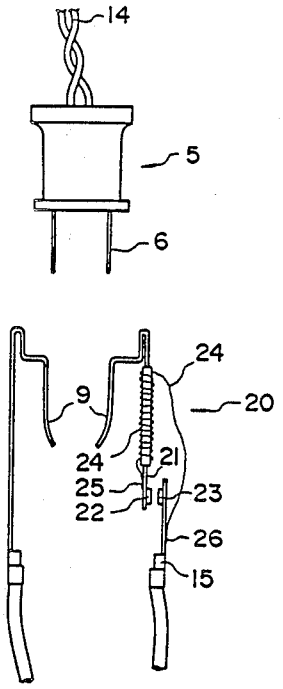
Figure 6A:
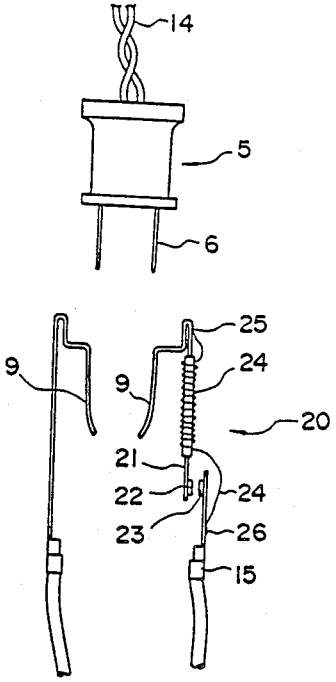
Figure 6C:
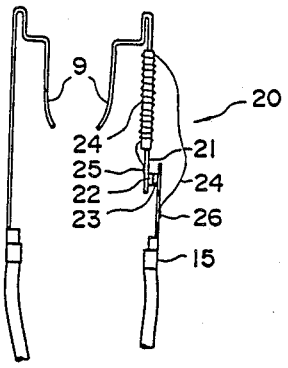
FIG. 6C shows the close of a contact in the flasher means of FIGS. 6A and 6B.

Within a flasher socket 8, there are provided a plain electrode or blade 9 and a flasher electrode formed by connecting in series a terminal 15, a flasher assembly 20 and a plain blade 9. The flasher assembly 20 further constitutes a bimetal plate and electric heating wire such as a Ni—Cr wire. electric heating wire is wound on one member of 24, wire electric heating wire with its two ends connected respectively to bimetal 21 and terminal 15, two wiring possibilities are shown in FIGS. 6A and 6B, with one end on the point 25 of the bimetal 21 and the other end on the terminal 15, in other words, the heating wire is seriesly connected in the circuit. The heating wire having greater electric resistance, when the circuit is on. When the load (string) is connected, however, the voltage drop distributed to the string is not enough to make the string lit, yet the heating wire takes most of the voltage drop and consumes the most part of the power, heat is generated and causes the temperature rise of the bimetal 21 which is bent to close the two contact points 22, 23, such as shown in FIG. 6C. A shunt is established and most of the current passes through points 22, 23, bimetal 21 to blade 9. Only very little current passes through heat wire 24. Now that the load (string) takes most part of the voltage drop, bulbs connected through the socket are lit, the other path of the shunt, or the heat wire 24 takes very few voltage drop the bimetal then cools down and is bent to resume its original position to break the contact of points 22, 23. The situation in FIG. 6A or 6B is restored. The string is turned off, the wire again takes most of the voltage drop, . . . and a new cycle starts, thus the flasher function is performed. The action of flashing described herein is reversed with the "built-in" flasher means of the light string allowing the corrected bulb to glow when the current is on and light off until the bimetal is being heated. When flashers of the two different types are connected in series, the combined flash effect is quite interesting and fantastic.

Figure 7:
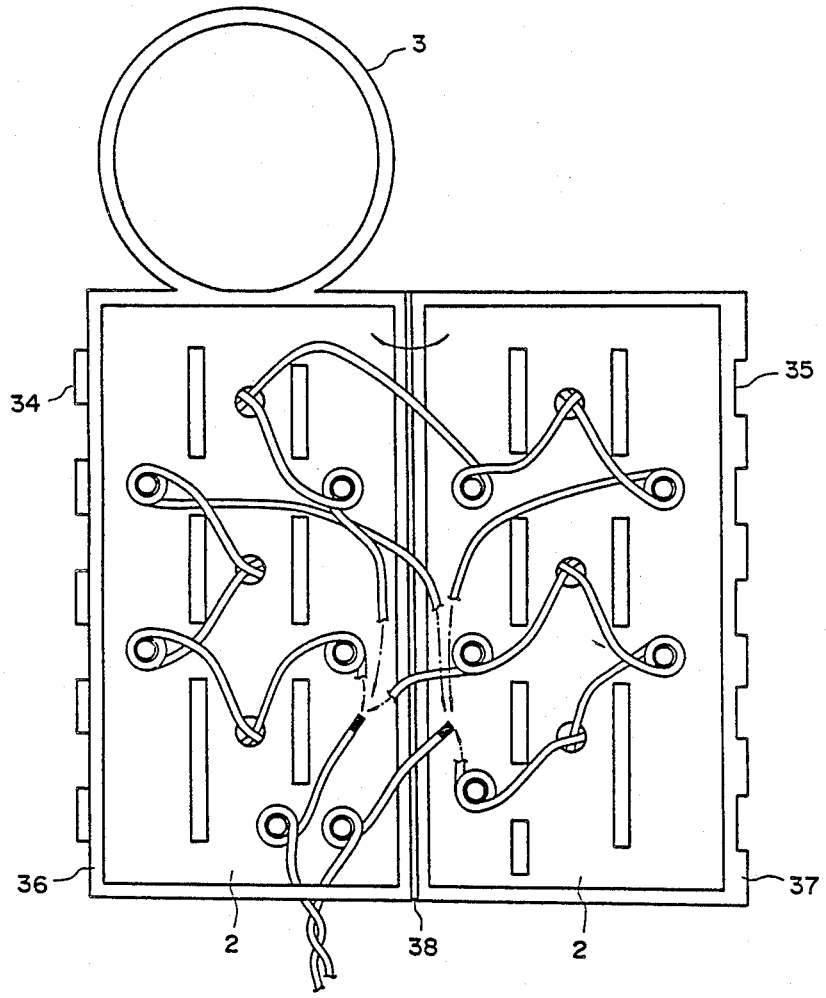
FIG. 7 shows an expansion of an distribution box of rectangular configuration with its two halves and a hanging ring formed integrally.

FIG. 7 shows an expansion of two halves of a distribution box, where connecting seam 38 of the two halves 2—2 being integrally fored, edges 35, 37 and 34, 36 may be made concave-convexly matched, opposite edge may be snapped on, adhesive may be applied when necessary to result in a seal tight box to insure water proof and safety.

I claim:

1. A distribution hanger for decorative light strips, comprising a box made of insulation material having a power inlet extending into said box, wire connections extending through said inlet into the interior of said box, a plurality of outlets, a hanger extending out of said box, a pair of posts adjacent said inlet, said outlets comprising individual electrical sockets extending through the wall of said box at a plurality of locations and having respective socket portions opening outwardly of said box, said wire connections extending from said inlet around respective ones of said post and being connected to said electrical sockets, said box being hangable at an elevated location so that a plurality of light strings may be distributed therefrom.

2. Distribution hanger according to claim 1, wherein partitions and said posts are provided within the box to facilitate the fixation, anchoring and/or isolation of parts such as blades, conductor, wires, electrodes, etc.

3. Distribution hanger according to claim 1, wherein said box is of circular shape, with a ring or hook serves as a hanger and is formed integrally with said box.

4. A distribution hanger according to claim 1, wherein: said plurality of outlets includes at least one outlet having a flasher means to one of interrupt or partially interrupt current supply to one of said electrical sockets.

5. A distribution hanger according to claim 4, wherein: said flasher means includes a bimetal portion connected to an electrode portion, a heating wire connected to said electrode portion and to a terminal electrically connected with said power inlet, said heating wire being wrapped around said bimetal portion to transfer heat to said bimetal portion, each of said terminal and said bimetal portion having a contact point, said heating wire transferring heat to said bimetal portion causing said contact points of said bimetal portion and said terminal to make contact.

6. A distribution hanger according to claim 5, wherein: said heating wire has an electric resistance which is greater than the electric resistance of said bimetal portion and said predetermined load.

7. A distribution hanger for decorative light strips, comprising: a box formed of insulation material having a power inlet; power wire connections extending through said inlet into the interior of said box; a hanger extending out of said box; a pair of posts adjacent said inlet, a plurality of extension pairs connected to said power wire connections extending through said wall, said box at a plurality of spaced locations, a plurality of pairs of posts, each pair positioned within said box, said wire connections extending from said inlet around respective ones of said posts and being connected to respective extension pairs, said box being composed of two joined members integrally formed to constitute two one-half portions of said box body which serve as a body and a lid, said two half portions having open edges made concave, convexly matched to be snapped to form a tightly closed box, said box being hangable at an elevated location so that a plurality of light strings may be distributed therefrom.

* * * * *